US010920961B2

(12) United States Patent
Loible et al.

(10) Patent No.: US 10,920,961 B2
(45) Date of Patent: Feb. 16, 2021

(54) LIGHTING UNIT

(71) Applicants: MACHINE SHOP HOLDINGS LTD, London (GB); GAVO LIGHTING LTD, Radlett (GB)

(72) Inventors: Steve Loible, London (GB); Rob Gavigan, Radlett (GB)

(73) Assignees: MACHINE SHOP HOLDINGS LTD, London (GB); GAVO LIGHTING LTD., Hertfordshire (GB)

( * ) Notice: Subject to any disclaimer, the term of this patent is extended or adjusted under 35 U.S.C. 154(b) by 0 days.

(21) Appl. No.: 16/473,059

(22) PCT Filed: Dec. 22, 2017

(86) PCT No.: PCT/GB2017/053884

§ 371 (c)(1),
(2) Date: Jun. 24, 2019

(87) PCT Pub. No.: WO2018/115905

PCT Pub. Date: Jun. 28, 2018

(65) Prior Publication Data

US 2019/0331319 A1 Oct. 31, 2019

(30) Foreign Application Priority Data

Dec. 23, 2016 (GB) ..... 1622109.5

(51) Int. Cl.
*F21V 9/02* (2018.01)
*F21V 17/00* (2006.01)
(Continued)

(52) U.S. Cl.
CPC ..... *F21V 9/02* (2013.01); *F21V 17/002* (2013.01); *F21V 17/08* (2013.01); *F21V 17/18* (2013.01); *F21W 2131/406* (2013.01)

(58) Field of Classification Search
CPC ..... F21V 9/00–08; F21V 17/00–18; F21W 2131/406
(Continued)

(56) References Cited

U.S. PATENT DOCUMENTS 2,927,200 A * 3/1960 Guth, Sr. ..... F21V 11/06 362/330
3,255,666 A 6/1966 Davis et al.
(Continued)

OTHER PUBLICATIONS

Invitation to Pay Additional Fees Corresponding to PCT/GB2017/053884 dated Apr. 5, 2018.
(Continued)

*Primary Examiner* — Jason M Han
(74) *Attorney, Agent, or Firm* — Davis & Bujold PLLC; Michael J. Bujold

(57) ABSTRACT

A lighting unit comprises a mount for rotating a plasma light source within a cylinder of metal gauze that provides a primary Faraday cage for shielding against radio-frequency radiation from the light source. The shielding is extended using a parabolic reflector for the emitted light in combination with a gauze to establish a secondary Faraday shield enclosing the primary cage. The gauze covers a ring that is sealed between the rim of the front open-mouth of the reflector and a slide-in cassette of the lighting unit, and can be of a metallic honeycomb configuration enhancing the operation and light output from the unit.

12 Claims, 5 Drawing Sheets

(51) Int. Cl.

| | |
|---|---|
| ***F21V 17/08*** | (2006.01) |
| ***F21V 17/18*** | (2006.01) |
| *F21W 131/406* | (2006.01) |

(58) Field of Classification Search
USPC ..... 362/249.02, 277, 319, 351, 367, 433, 362/455–458
See application file for complete search history.

(56) References Cited

U.S. PATENT DOCUMENTS

| | | | | |
|---|---|---|---|---|
| 5,622,426 | A | 4/1997 | Romano et al. | |
| 6,244,730 | B1 | 6/2001 | Goldberg et al. | |
| 8,101,931 | B2 * | 1/2012 | Blandford, III ..... | H01J 65/044 174/357 |
| 8,690,391 | B2 * | 4/2014 | Drake ..... | F21V 11/183 362/247 |
| 2008/0106906 | A1 | 5/2008 | Lewsadder et al. | |
| 2010/0157604 | A1 | 6/2010 | Quadri et al. | |

OTHER PUBLICATIONS

International Search Report Corresponding to PCT/GB2017/053884 dated May 28, 2018.
Written Opinion Corresponding to PCT/GB2017/053884 dated May 28, 2018.

* cited by examiner

LIGHTING UNIT

This application is a National Stage completion of PCT/GB2017/053884 filed Dec. 22, 2017, which claims priority from British patent application serial no. 1622109.5 filed Dec. 23, 2016.

FIELD OF THE INVENTION

This invention relates to a lighting unit, and in particular a lighting unit for use in situations where a high level of illumination is required, and also where removable accessories such as filters or lenses may be required. Such lighting units are required for example for stage lighting.

BACKGROUND OF THE INVENTION

Stage lighting units are commonly cumbersome units which require separate supports for mounting lenses or filters in front of the light source. This means that there are often gaps around the edges of the light allowing leakage of light sideways, in addition, the light source may be required to be of high power in order to provide sufficient illumination, and consequently may become very hot so that the unit heats up and is difficult to handle.

This invention aims to provide a lighting unit that may be adopted to alleviate such problems.

SUMMARY OF THE INVENTION

According to an aspect of the present invention, there is provided a lighting unit comprising a mount for a light source, a cassette arranged to house at least one removable element for conditioning light from the light source, and at least one frame member arranged to support the cassette in front of the mount. This provides a compact unit where elements such as lenses or filters may easily be interchanged. Furthermore such an arrangement can reduce any gaps between the light source and elements such as filters, lenses and shutters, so as to reduce leakage of light around the sides of the unit.

The cassette may be configured such that the or each element is accessible from a side of the cassette. For example, the cassette may have at least one movable side portion or gate, which may be opened to allow insertion or removal of an element, and may be latched in position in use. The, or each, gate may be shaped closely to receive a predetermined type of element. Where a plurality of such gates is provided, the gates may be elongate and substantially parallel, and may together form a side of the cassette. The gates are preferably latchable to each other, for example using a locking pin, which may also be used to latch each gate in the closed position.

The elements such as filters, lenses and shutters may be supported by shaped features associated with at least one other side of the cassette, to hold them in place. For example, low friction features such as runners may be provided.

Preferably the cassette comprises side walls which are substantially impermeable to light, such that light leakage around the sides of the unit is alleviated. The cassette may be substantially oblong or square in shape, so as to facilitate loading of elements. A rear wall of the cassette may have a circular aperture for light from the light source, and the unit may comprise a shutter assembly arranged to be mounted in front of the cassette for shielding externally of light emitted by the light source, the assembly also preferably having a circular aperture. The shutter assembly may for example comprise at least one pair of shutter members, and preferably three or four members, movable towards or away from the aperture for example by a pivoting movement.

The unit may comprise a reflector mounted behind the cassette for surrounding the light source. The reflector may for example be of a conical or dome shape, and may provide or include radio frequency shielding. Further, light and/or radio frequency shielding may be provided in the form of a pierced metallic plate or gauze directly in front of the reflector especially in the case where a plasma bulb is used to provide the light source. Thus the reflector may be attached at its front edge to a shield such as a gauze for providing radio frequency shielding whilst allowing the passage of light. Such shielding is of particular use where a light source such as a plasma light source is to be mounted in the reflector, since the plasma light and power supply can adversely affect nearby wireless devices by radio frequency interference.

The gauze may be in the form of a lattice such as a honeycomb lattice, which also may have the advantage of enhancing the optical properties of the lighting unit. It has been found that such a lattice does not negatively affect the quality of the light produced by the unit. For example it may be formed of thin strip-like material.

Thus the invention also provides a lighting unit comprising a mount for a light source, and a shield arranged to be mounted in front of the light source, the shield providing radio frequency shielding whilst allowing the passage of light, and preferably comprising a gauze of substantially honeycomb configuration and formed of a metallic material. The invention may also provide a reflector for surrounding the mount and arranged for directing light forwardly, the reflector and the shield together arranged to form a Faraday cage around the light source.

The mount may include a mechanism for allowing rotation of the light source, and may include cooling fins for dissipating heat created by the light source in use.

The frame member(s) may include a plurality of legs extending between the mount and the cassette, preferably around the reflector, which are preferably light in weight. The legs provide structural strength to the unit whilst also forming a 'cage' for protecting the reflector and also allowing cooling thereof. Thus the invention may also provide a lighting unit comprising a mount for a light source, a reflector surrounding the mount, and support arms arranged to provide a frame around the reflector.

Support arms may also be provided attached to the unit, for example to the frame member(s) such as the legs, at an attachment location which is arranged to be moveable on the unit, preferably in an axial direction, such that the unit may be balanced on the arms. For example the attachment locations may be arranged along the legs, which may be provided with a plurality of attachment features such as apertures.

Various interchangeable elements may be provided with the unit, such as lenses and filters. An appropriate attachment location may be selected depending upon the weight of the elements fitted to the unit, and thus the balance of the unit.

BRIEF DESCRIPTION OF THE DRAWINGS

In order that the invention may be more readily understood, reference will now be made, by way of example, to the accompanying drawings, in which.

DETAILED DESCRIPTION OF THE PREFERRED EMBODIMENTS

Figure 1:
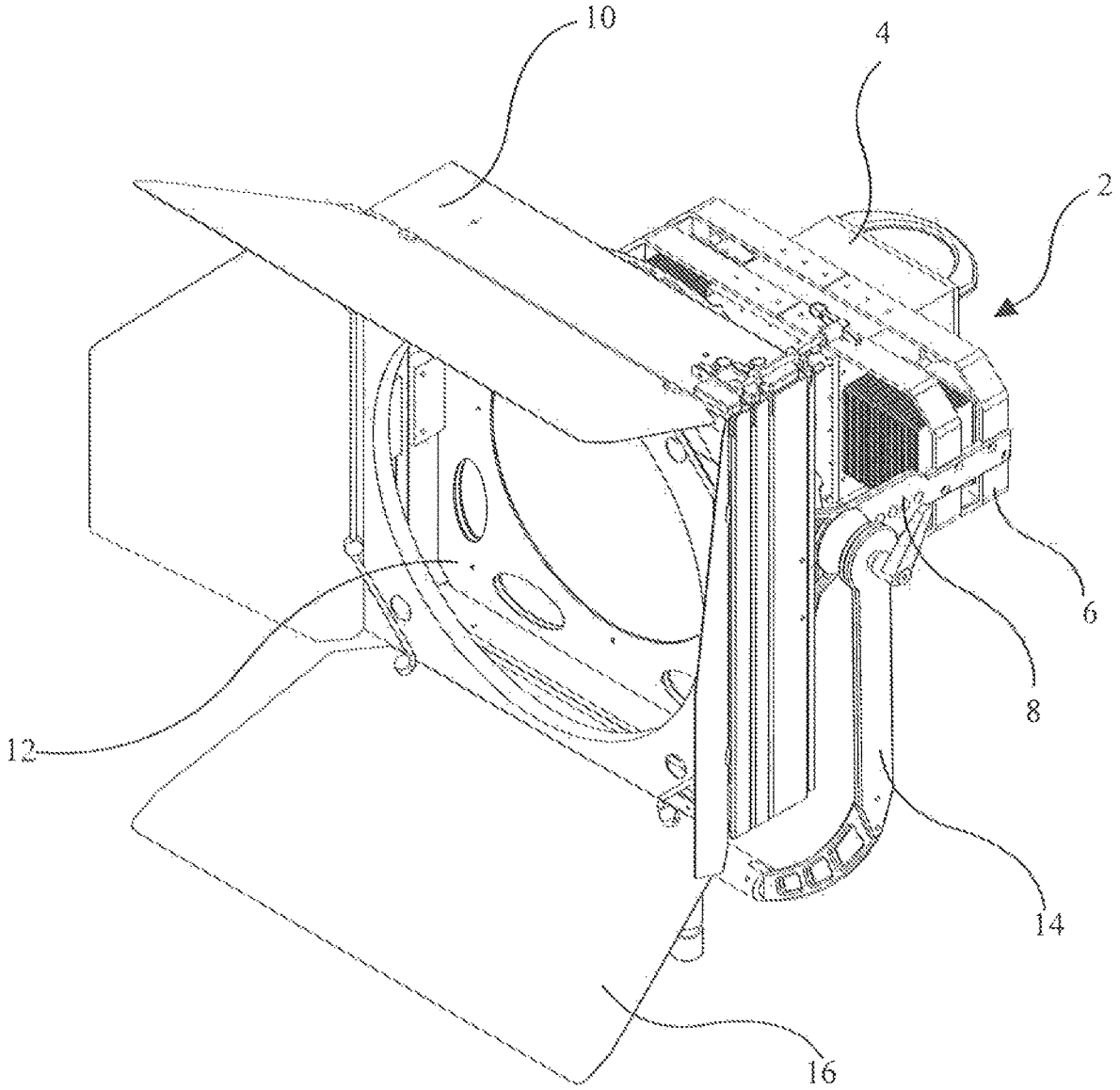
FIG. 1 is a perspective view of a lighting unit according to the invention.

Referring to FIG. 1, the lighting unit 2 comprises a mount 4 for a light source such as a plasma lamp (not shown). The mount 4 includes a bracket 6, with a plurality of frame members 8 in the form of legs extending from the bracket 6 to a cassette 10, and supporting the cassette 10 in front of the light mount 4. The cassette is arranged to support removable elements for conditioning the light from the unit, such as a lens element 12 and/or filter element. The unit is provided with support arms 14 for holding the unit 2 in the required position in use. Shutters 16 may be mounted to the front of the cassette 10.

Figure 4:
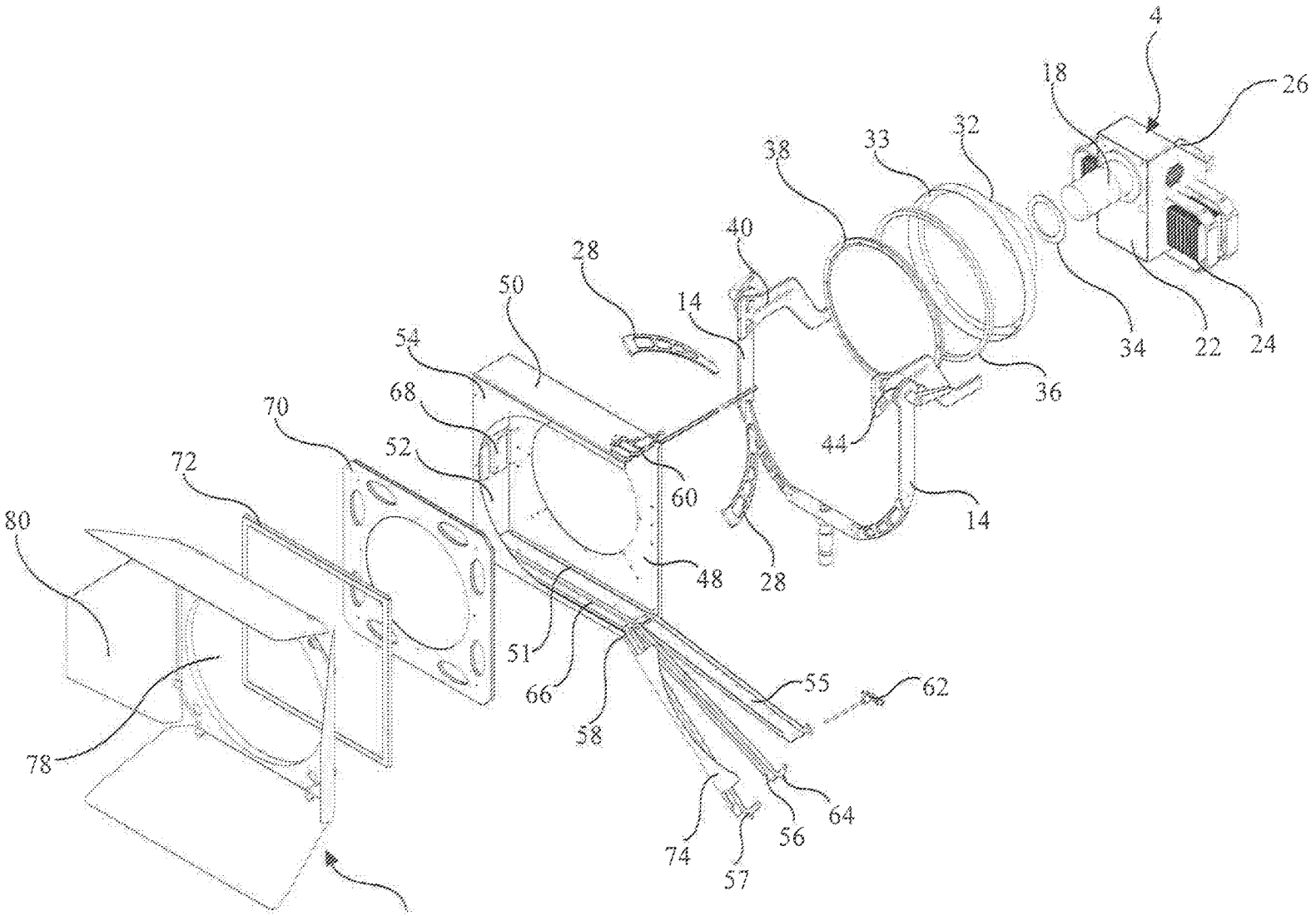
FIG. 4 is an exploded perspective view of the unit.

Referring to the other figures, and in particular to FIG. 4, the light source mount 4 in this example has a plasma light source (not shown) that is mounted on a rotating bearing (not shown) within a metallic cylinder 18 that projects form the front face of the mount 4. Where a light source other than a plasma source is used, the rotating bearing may be omitted. The mount 4 includes a bank of cooling fins 24 mounted on opposed side faces 26 thereof. Brackets 6 comprising a pair of elongate bracket members 27 surround the cooling fins 24.

Figure 2:
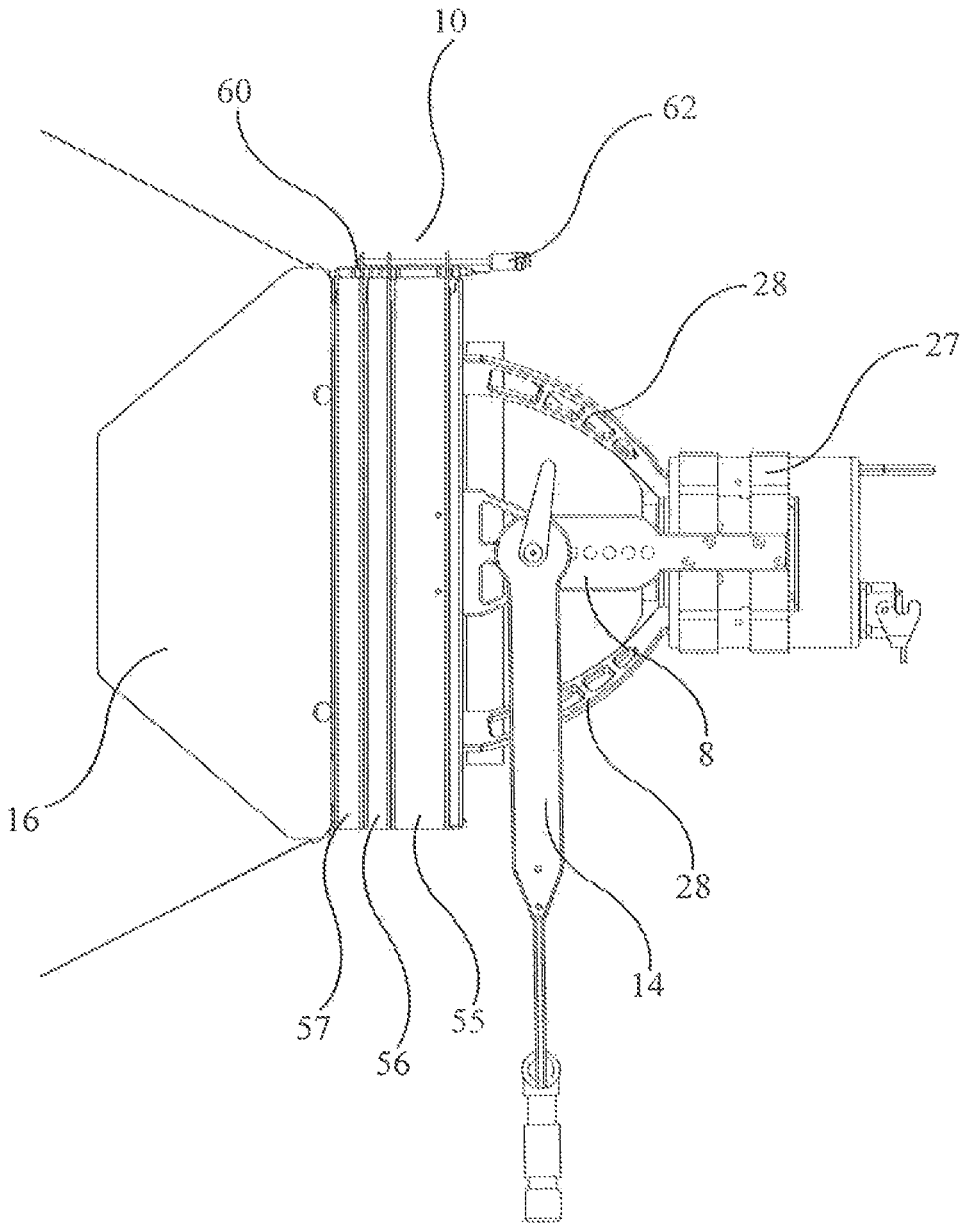
FIG. 2 is a side view of the unit of FIG. 1.
Figure 3:
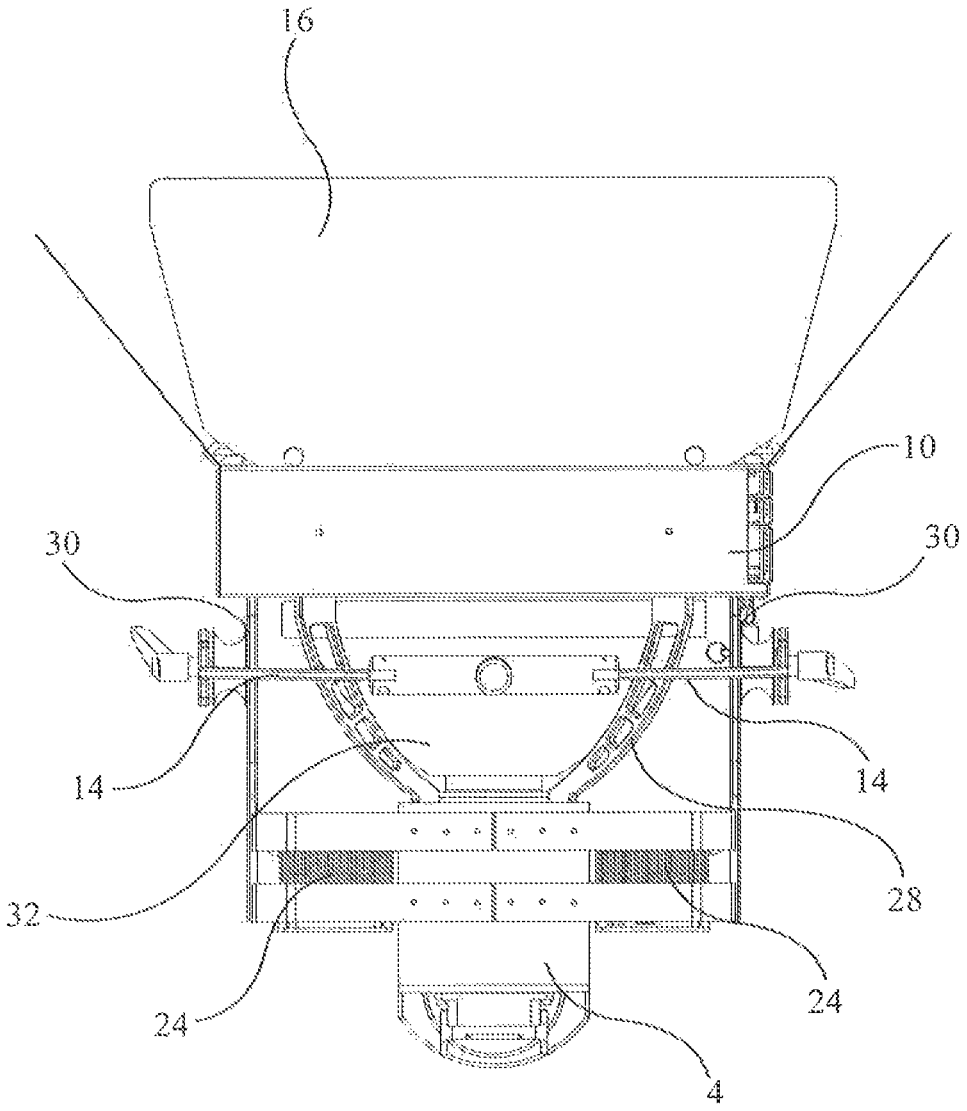
FIG. 3 is an underneath view of the lighting unit.

As can be seen in FIGS. 2 and 3, the mount 4 is connected to the cassette 10 by frame members including two pairs of lightweight reflector legs 28, and a pair of opposed side legs 8. The side legs 30 are connected to the brackets 28. The legs 28, 30 are preferably of a lightweight material such as machined aluminium, and may for example be coloured for aesthetic reasons. To reduce weight, the legs 28, 8 have cut out sections, which can also act as hand holds for manipulating the lighting unit.

The legs 28, 8 are shaped closely to surround a reflector 32, which may be of parabolic-mirror form, and which has a continuous dome-like surface sealed to the light source mount 4 using a metallic seal 34 so as to surround the light source within the metallic cylinder 18 and direct light forwardly in a substantially circular cross sectional shape. The metallic seal 34 forms a conducting seal between the reflector 32 and a grounded mounting point on the light source mount 4.

Figure 5:
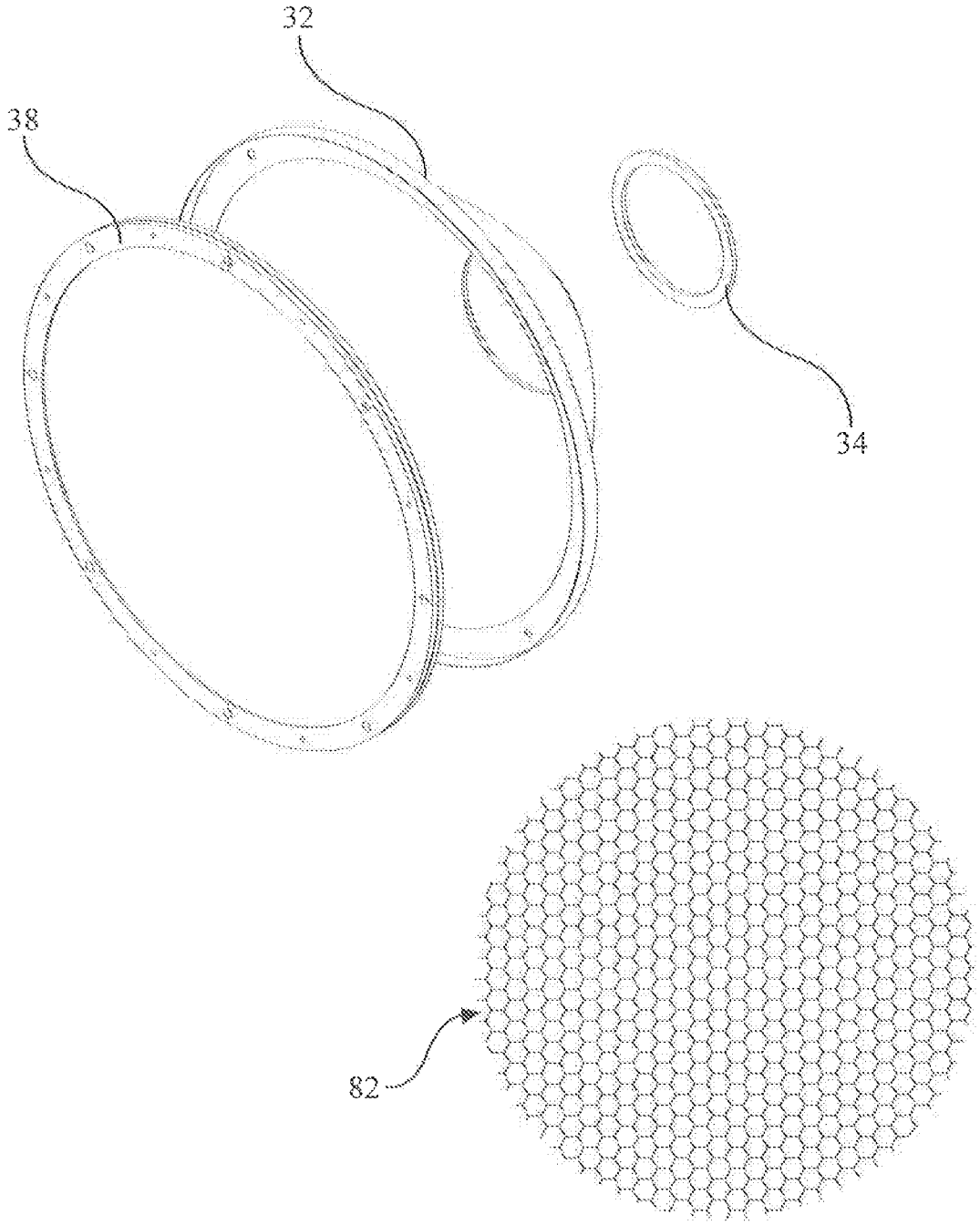
FIG. 5 is an exploded perspective view of the lighting unit.

The reflector 32 is sealed to the cassette 10 at its forward circular rim 33 (see FIG. 4) via a further seal arrangement formed of a sealing strip 36 and a metal ring 38 covered wholly by metallic gauze 82 (not shown in FIG. 4, but see FIG. 5). The sealing strip or ring 36 is made of a metallic foam so as to provide an electrically-conductive interconnection between the reflector 32 and the ring 38 with the gauze covering it. The reflector 32 may be formed of a radio frequency shielding material, and the seals may also have radio frequency shielding properties, for example by being manufactured from an electrically-conductive material and being grounded in use. In this way, the mount 4, the reflector 32, and the ring 38 covered with gauze 38 together establish a secondary Faraday cage that encloses the primary Faraday cage established with the mount 4 by the metallic-gauze cylinder 18 enclosing the plasma-tube light. FIG. 5 illustrates an example of the sealing gauze 82, which in this example has a honeycomb-like structure of holes that allow light to pass through. The gauze 82 is of electrically-conductive material with holes which may differ in shape from one another but which are of substantially similar size to one another.

Referring to FIG. 3 especially, side legs 30, which may be substantially flat and elongate, may each comprise a plurality of apertures 40 (FIG. 4) to provide attachment locations for a pair of opposed support arms 14. The arms 14 may extend around the unit and may be joined together to provide a handle. The arms 14 may be pivotable on the side legs 30 via one of the apertures 40, and may be adjustable to a required position along the length of the legs 30 by selecting an aperture 40. Thus the arms 14 may be moved axially of the unit until the unit 2 is substantially balanced on the arms 14 so as to reduce any force tending to tip the unit 2 upwardly or downwardly around the pivot. The arms 14 are provided with resilient washers 44, for example of cork, and a locking tab 46 for securing the unit in a fixed orientation on the arms 14 depending upon the required direction of the light in use.

The cassette 10 has a rear plate 48 having a circular aperture aligned with the front rim 33 of the reflector 32, the rear plate being sealed to upper and lower walls 50, 51 and a side wall 52. The walls 50, 52 are each sealed to a front face member 54 forming part of a circular front aperture of the cassette. Opposite the side wall 52, the remaining side of the cassette is formed from a plurality of gates 55, 56, 57 that are pivotable about the lower corner 58 of the cassette formed by one end of the lower wall 51, so as to be moveable towards or away from the cassette to allow access to the interior. The gates 56 can be latched to the upper corner 60 formed by the end of the upper wall 50, so as together to form the remaining side wall of the cassette 10. In this respect, a latching pin 62 may be provided to pass through aperture tabs 64 in the free end of each gate, and corresponding apertures on the cassette.

The inner surface of the walls of the cassette may also be provided with formations such as runners 66 and recesses 68 which are each aligned with a gate to facilitate insertion and/or removal of an element such as a lens mount 70 or a filter mount 72, each of which are square in shape and arranged to fit closely within the cassette via the gates. Further examples include an "egg crate", which is intended to reduce or prevent sideways light spill, in this example three gates are provided for optionally mounting three elements in the cassette. The front-most gate 57 has a front plate 74 which is configured to complete a circular aperture in the front of the cassette with the front face member 54.

A shutter arrangement 76 may be attached to the front of the cassette, having an aperture 78 for aligning with the aperture formed by the front face member 54 and front plate 57 of the cassette 10. The shutter arrangement 76 is also square in shape, and has pairs of shutter members 80, commonly known as barn doors, pivotally attached to each edge.

In use, the lighting unit has the advantage that, due to the frame arrangement, it is lightweight and does not become very hot. Thus the shutter arrangement 76 does not heat up and become warped, which can lead to it falling off. Because of this, previous 'barn doors' have required a tether attaching them to the body of the light for safety reasons. Thus the shutters according to this invention may be attached in any orientation and may more easily be manipulated in use of the unit. Furthermore the support does not become hot so may easily be adjusted. Also the cassette provides ease of changing the elements required to condition the light, and helps to eliminate gaps around the side of the unit.

Furthermore, the lightweight structure and lack of significant heating of the lighting unit allows the unit to be hung directed vertically downward at a location, such as on a set. For example, a plurality of lighting units may be suspended to provide an ambient daylight effect in an efficient manner, without suffering the drawbacks associated with overheating that current lighting units have. With prior lighting units, if they face downwardly, heat from the light tends to build in the reflector and may even cause melting.

Any system feature as described herein may also be provided as a method feature, and vice versa. As used herein, means plus function features may be expressed alternatively in terms of their corresponding structure.

Any feature in one aspect of the invention may be applied to other aspects of the invention, in any appropriate combination. In particular, method aspects may be applied to system aspects, and vice versa. Furthermore, any, some and/or all features in one aspect can be applied to any, some and/or all features in any other aspect, appropriate combination.

It should also be appreciated that particular combinations of the various features described and defined in any aspects of the invention can be implemented and/or supplied and/or used independently.

The invention claimed is:

1. A lighting unit comprising:

a mount for a plasma light source, a reflector having an open end for directing light forwardly from the light source, at least one removable light-conditioning element, a cassette arranged to house the at least one removable light-conditioning element for conditioning light from the light source, at least one frame member supporting the cassette in front of the forward open end of the reflector, and the cassette having a side openable for receiving entry of the at least one removable light-conditioning element into the cassette for conditioning the light from the light source, and the light-conditioning element and the reflector both provide shielding against radio-frequency radiation from the plasma light source.

2. The lighting unit as claimed in claim 1, wherein the cassette has an interior, and the interior of the cassette includes guides configured to cooperate with at least one edge of the at least one removable light-conditioning element to hold the at least one removable light-conditioning element in place.

3. The lighting unit as claimed in claim 1, comprising a reflector mounted between the mount for a light source and the cassette, for guiding light from the light source toward the cassette.

4. The lighting unit as claimed in claim 3, in which the reflector has radio-frequency shielding properties.

5. The lighting unit as claimed in claim 1, wherein the mount for a light source comprises a mount for rotating the light source.

6. The lighting unit as claimed in claim 1, comprising a further element having at least a central region comprising material for conditioning light.

7. The lighting unit as claimed in claim 6, wherein the material of the at least a central region of the further element comprises a lattice material having radio-frequency shielding properties.

8. The lighting unit as claimed in claim 1, wherein the mount for a light source is a mount for a plasma light source.

9. A lighting unit comprising:

a plasma light source, a mount for the plasma light source, a shield mounted with the mount for shielding against radio-frequency radiation from the plasma light source, the shield providing the radio-frequency shielding whilst allowing the passage of light from the plasma light source through the shield, a reflector for directing light forwardly from the light source, the reflector having a forward open end through which the forwardly-directed light exits the reflector, and a light-conditioning element located in front of the forward open end of the reflector, wherein the light-conditioning element is of a lattice open-cell form, and the light-conditioning element and the reflector both provide shielding against radio-frequency radiation from the plasma light source.

10. The lighting unit as claimed in claim 9, wherein the shield comprises a gauze of substantially honeycomb configuration and formed of a metallic material.

11. The lighting unit as claimed in claim 9, comprising a primary Faraday cage enclosing the plasma light source, and a secondary Faraday cage enclosing the first Faraday cage, and the primary and secondary Faraday cages each provide shielding against radio-frequency radiation from the plasma light source.

12. A lighting unit comprising:

a plasma light source, a rotatable mount mounting the plasma light source, a Faraday cage enclosing the plasma light source for shielding against radio-frequency radiation from the plasma light source, the Faraday cage providing the radio-frequency shielding whilst allowing light from the plasma light source to exit the Faraday cage, a light-conditioning element having a lattice-structure of holes for light to pass through, and optical means directing the light exiting the Faraday cage to pass through the holes of the light-conditioning element, and a further Faraday cage, wherein the Faraday cage enclosing the plasma light source is enclosed within the further Faraday cage, and the light-conditioning element is electrically-conductive to form part of the further Faraday cage.

* * * * *